US008106323B2

(12) United States Patent
Liu et al.

(10) Patent No.: US 8,106,323 B2
(45) Date of Patent: Jan. 31, 2012

(54) POTENTIAL SWITCHING APPARATUS FOR POWER ADAPTER

(75) Inventors: Wen-Chi Liu, Taoyuan Hsien (TW); Chi-Tsung Liang, Taoyuan Hsien (TW); Chia-Cheng Liu, Taoyuan Hsien (TW)

(73) Assignee: FSP Technology Inc., Taoyuan, Taoyuan Hsien (TW)

( * ) Notice: Subject to any disclaimer, the term of this patent is extended or adjusted under 35 U.S.C. 154(b) by 410 days.

(21) Appl. No.: 12/346,263

(22) Filed: Dec. 30, 2008

(65) Prior Publication Data

US 2010/0163393 A1 Jul. 1, 2010

(51) Int. Cl.
*H01H 19/20* (2006.01)

(52) U.S. Cl. ..... 200/570; 200/51.11

(58) Field of Classification Search ..... 200/51 R, 200/51.11, 564, 565, 570, 571
See application file for complete search history.

(56) References Cited

U.S. PATENT DOCUMENTS

| | | | | |
|---|---|---|---|---|
| 5,329,083 | A * | 7/1994 | Lai | 200/302.2 |
| 5,911,586 | A * | 6/1999 | Wintergerst | 439/133 |
| 6,878,889 | B1 * | 4/2005 | Horst et al. | 200/51.11 |
| 2006/0137962 | A1 * | 6/2006 | Schluter et al. | 200/51 R |
| 2009/0219118 | A1 * | 9/2009 | Anderson | 335/2 |

FOREIGN PATENT DOCUMENTS

| | | |
|---|---|---|
| TW | M336623 | 7/2008 |

* cited by examiner

*Primary Examiner* — Gary F. Paumen
(74) *Attorney, Agent, or Firm* — Winston Hsu; Scott Margo

(57) ABSTRACT

A potential switching apparatus for a power adapter which transforms input power to output power delivered through a power output cord. The potential switch apparatus switches the potential of the output power. It includes a first body and a second body located on the power output cord. The first body has a first contact and a second contact. The second body has a switch element connectable to the first contact to deliver the output power at a first potential and connectable to the second contact to deliver the output power at a second potential. Thus the potential of the output power can be switched. The present invention improves the conventional potential switch device on the power adapter that is too bulky in size.

16 Claims, 15 Drawing Sheets

POTENTIAL SWITCHING APPARATUS FOR POWER ADAPTER

FIELD OF THE INVENTION

The present invention relates to a potential switching apparatus for power adapter and particularly to a switching apparatus to switch output potentials of a power adapter.

BACKGROUND OF THE INVENTION

A power adapter aims to transform input power to output power to supply an electronic device. A wide variety of electronic devices on the market require electric power of differential potentials. In order to make the power adapter to supply power to various types of electronic devices, the general approach is like the one shown in FIG. 1 in which a power adapter 100 is equipped with a horizontal switch 101 and a potential scale 102 indicating potential values. Users can move the horizontal switch 101 to adjust output power potential according to the electronic device connecting to the power adapter 100 to meet requirement thereof. The horizontal switch 101 switches the potential by sliding. Such a movement often cannot position at an accurate potential, but rather between two potential values of the potential scale 102. As a result, an inaccurate output potential is delivered from the power adapter 100.

To solve the aforesaid problem, R.O.C. patent No. M336623 discloses a dual-input power supply with adjustable output voltage, in which including a case with a window formed thereon, a circuit board held in the case, a voltage regulation knob electrically connected to the circuit board and a rotary wheel with voltage adjustment numerals formed thereon visible through the window. The voltage regulation knob is coupled with a rotary stem of the rotary wheel. To switch the output power potential, turn the rotary wheel and the rotary stem and drive the voltage regulation knob turning on the circuit board. Through the voltage adjustment numerals on the rotary wheel accurate output power of the power adapter can be set and delivered.

While the aforesaid conventional techniques can switch the potentials of output power, the switch is located on the case of the power adapter and connected to the circuit board in the power supply. The circuit board has to be made at a larger size to accommodate wiring and the switch. As a result, the size of the power adapter is larger and the production cost also is higher as well. The larger size also makes carrying difficult and takes too much space.

SUMMARY OF THE INVENTION

Therefore the primary object of the present invention is to solve the aforesaid disadvantages by providing a potential switching apparatus for power adapters that not only can switch output power potential also can be made at a smaller size and a lower production cost.

The potential switching apparatus for power adapters according to the present invention aims to transform input power to output power and switch the potential of the output power. It includes a first body and a second body located on a power output cord. The first body has a first contact and a second contact. The second body has a switch element which is connectable to the first contact to form a first potential of the output power and also connectable to the second contact to form a second potential of the output power.

By means of the present invention carrying of the power adapter is easier. It also makes the power adapter smaller to save space.

DETAILED DESCRIPTION OF THE PREFERRED EMBODIMENT

Below are described in detail the technical contents of the present invention.

Figure 1:
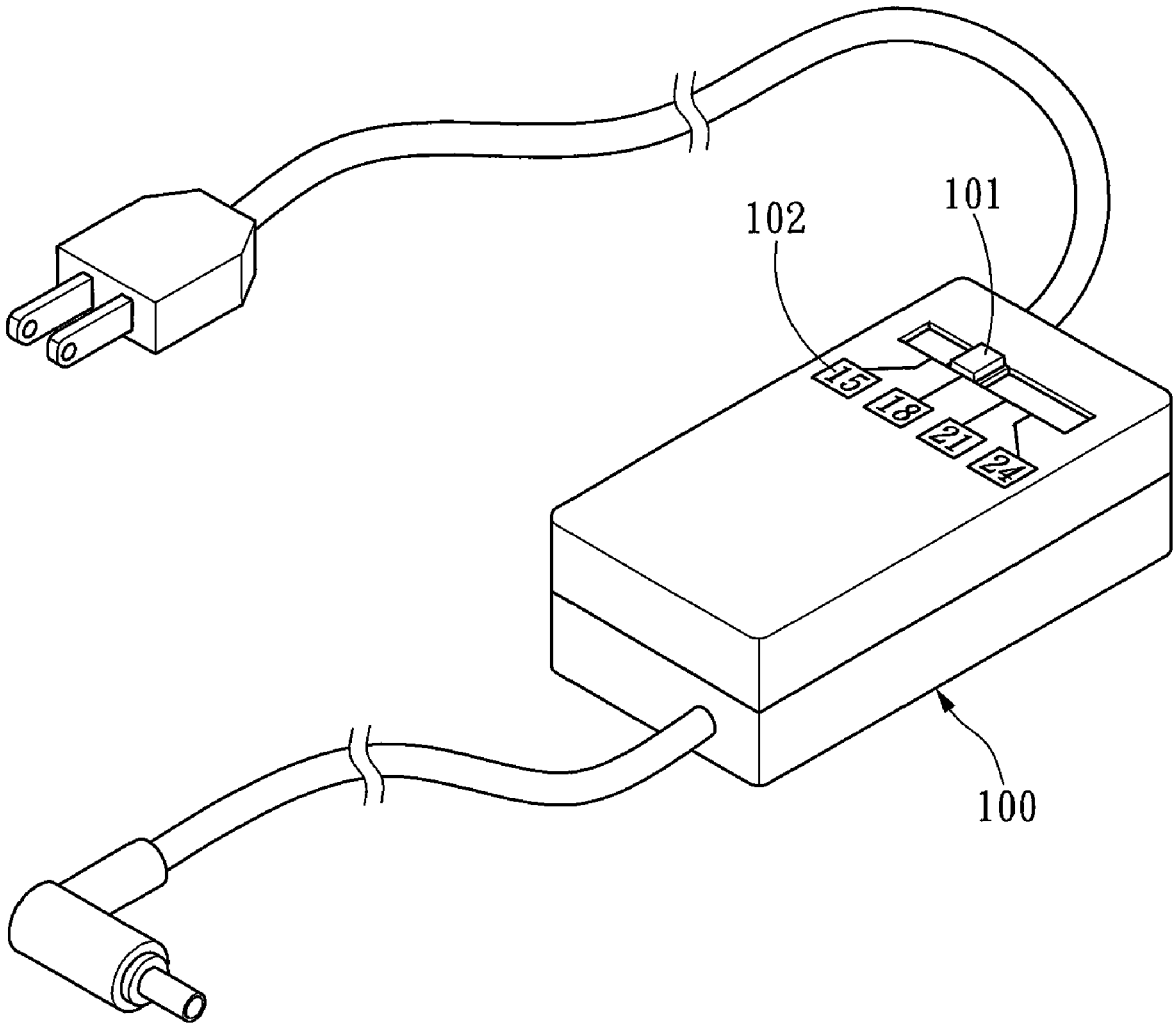
Fig. 1 PRIOR ART
FIG. 1 is a perspective view of a conventional power adapter.
Figure 2:
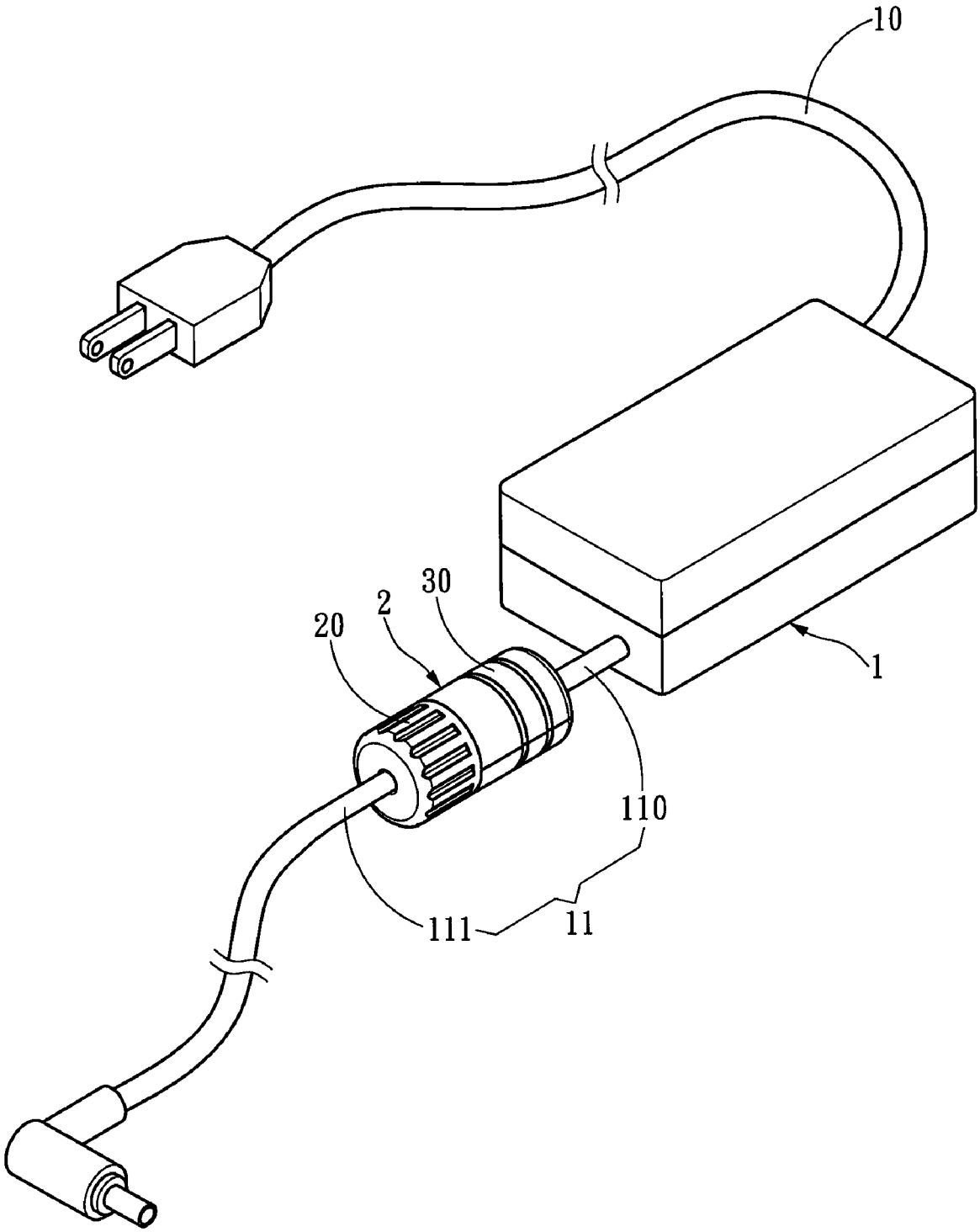
FIG. 2 is a perspective view of the present invention.
Figure 3:
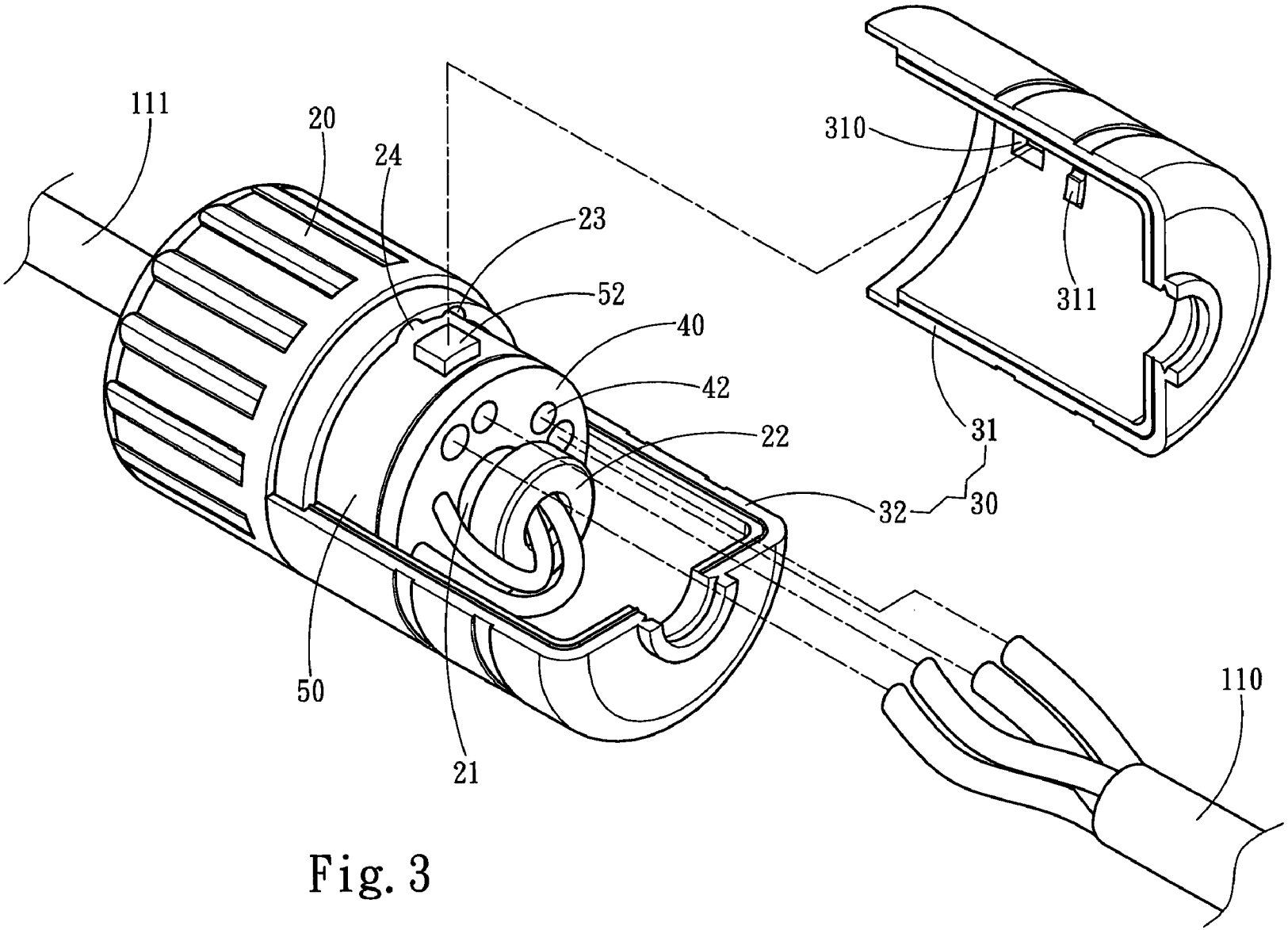
FIG. 3 is a partial exploded view of the present invention.
Figure 4A:
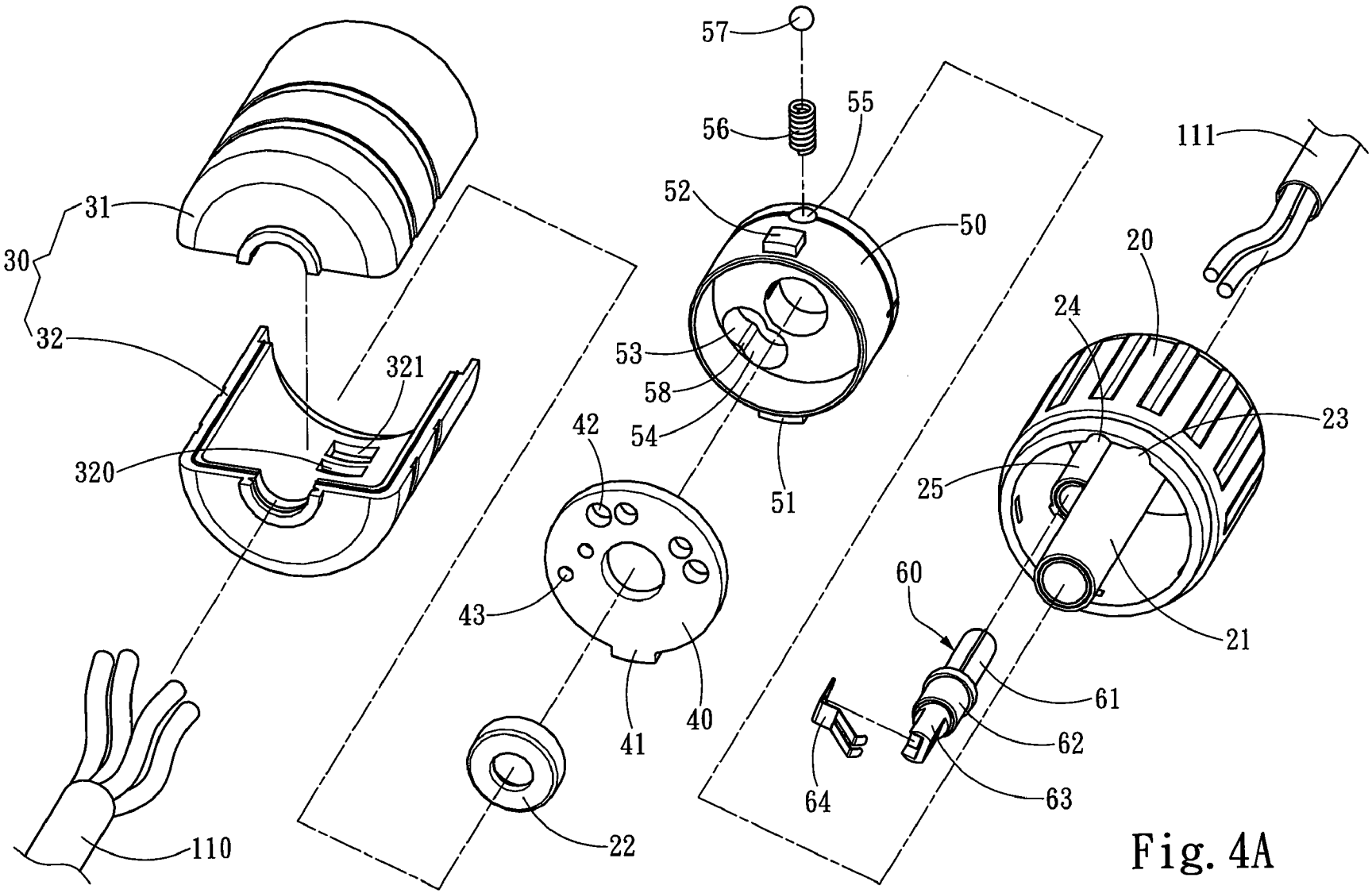
FIGS. 4A and 4B are exploded views of the present invention.
Figure 4B:
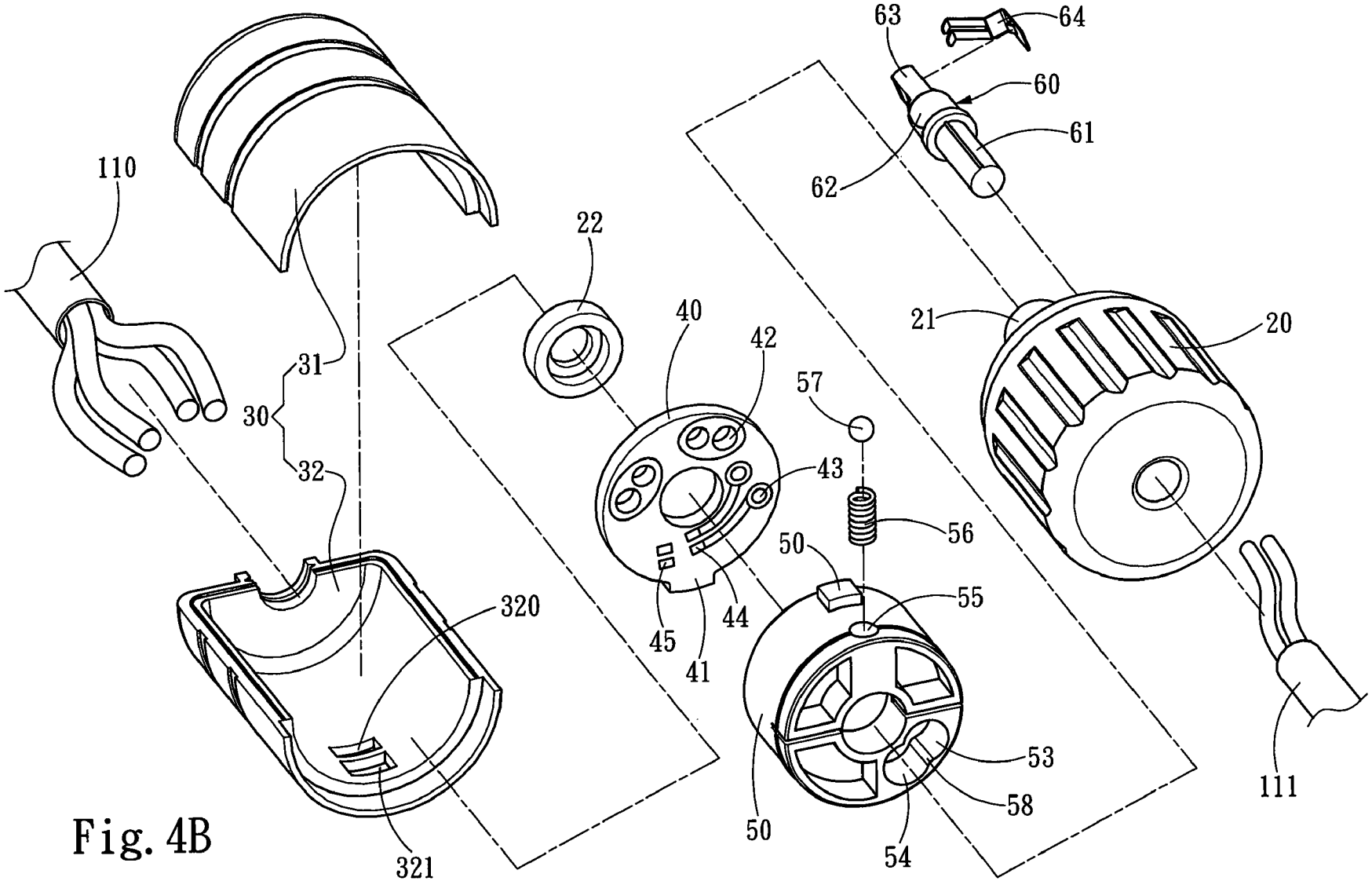

Please referring to FIGS. 2-4B, the potential switching apparatus of the present invention is adopted for use on a power adapter 1 which has a power input cord 10 and a power output cord 11 to transform input power to output power delivered through the power output cord 11. The potential switching apparatus 2 is located on the power output cord 11 to switch the potential of the output power, which has a first body 30 and a second body 20. In an embodiment of the present invention, the power output cord 11 includes a first cable 110 running through the first body 30 and a second cable 111 running through the second body 20. The first body 30 has an upper case 31 and a lower case 32 that correspond to each other and are coupled together. The first case 30 contains a shifting element 40 which has a coupling member 41 wedged in a coupling trough 320 of the lower case 32. The upper case 31 has a braking portion 311 holding the upper edge of the shifting element 40. The shifting element 40 is an adapter circuit board and has a plurality of power ports 42 and 43 linking to the first cable 110 and second cable 111, and also has a first contact 44 and a second contact 45. The second body 20 has a turning axle 21 running through the shifting element 40 and forming a turning displacement against the shifting element 40. The second body 20 further has a switch element 64 connecting to the first contact 44 in regular conditions to form a first potential for the output power. The switch element 64 can be moved away from the first contact 44 in the turning displacement of the second body 20 to connect the second contact 45 to switch the output power at a second potential.

In order to switch the output power at the second potential, when the second body 20 goes through the turning displacement and prevent the second body 20 from turning easily under an external force and resulting in change of the output power potential, the first body 30 and the second body 20 have a retaining member 50 and a switch stem 60 running through the retaining member 50 to form an anchoring effect. The turning axle 21 of the second body 20 also runs through the retaining member 50 and can generate a displacement against the retaining member 50 and the shifting element 40. The turning axle 21 has a detent member 22 at one end thereof to resist the shifting element 40 during the displacement. The switch stem 60 and the second body 20 have respectively a first coupling portion 61 and a second coupling portion 25 that are coupled with each other. The switch stem 60 further has a holding portion 63 to hold the switch element 64. The first coupling portion 61 and the holding portion 63 are interposed by an anchor portion 62 formed at a diameter greater than the holding portion 63. The retaining member 50 has fastening stubs 51 and 52 located respectively on an upper edge and a lower edge to wedge in holding troughs 310 and 321 formed on the upper case 31 and the lower case 32. The retaining member 50 also has a first anchor hole 53 and a second anchor hole 54 to form an anchoring relationship with the anchor portion 62 of the switch stem 60 in the turning displacement. As shown in the drawings, the first anchor hole 53 and the second anchor hole 54 are formed at a size substantially same as the anchor portion 62 and communicate with each other through a restriction zone 58 smaller than the anchor portion 62 to harness the anchor portion 62. The external diameter of the restriction zone 58 is smaller than the anchor portion 62 but greater than the holding portion 63. In addition, the retaining member 50 has a retaining cavity 55 to hold a spring 56 and a retaining ball 57 braced by the spring 56. The second body 20 has two sliding tracks 23 and 24 to confine the retaining ball 57 in the turning displacement. Thereby a click sense is generated during turning to ensure that the second body 20 is turned to a desired position.

Figure 5:
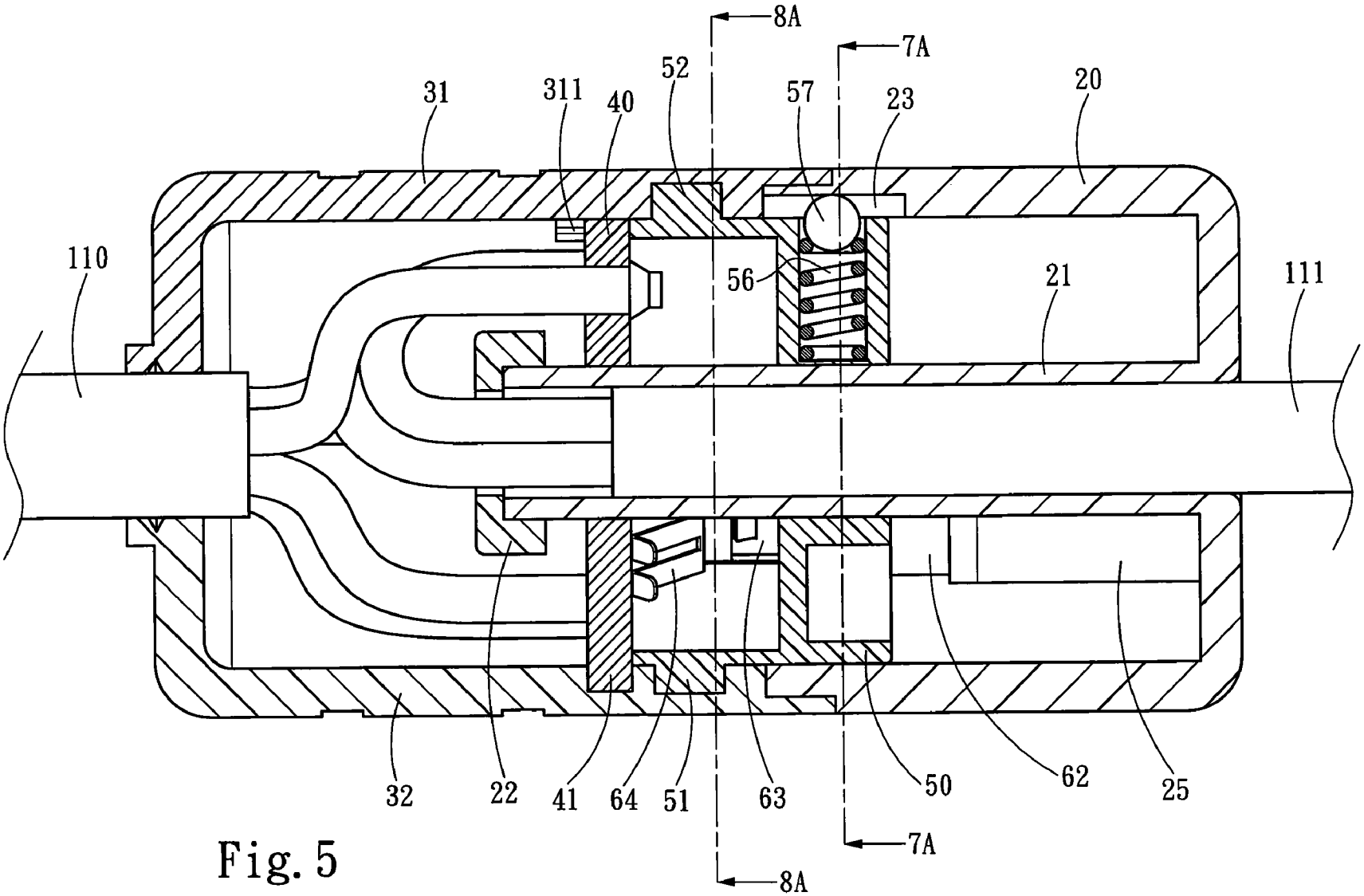
FIG. 5 is a sectional view of the present invention.
Figure 6A:
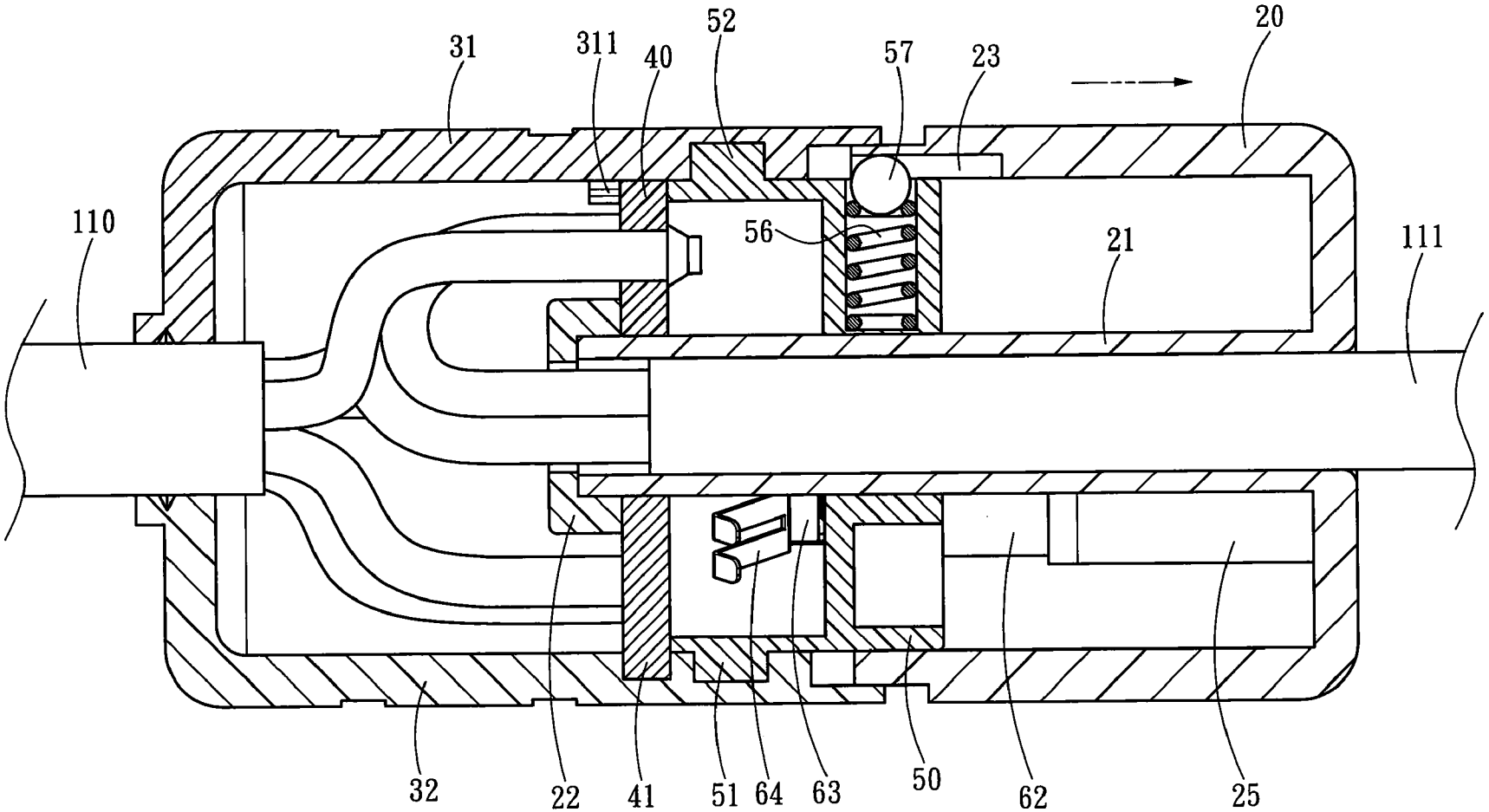
FIGS. 6A-6C are schematic views of the present invention in use condition-1.
Figure 6B:
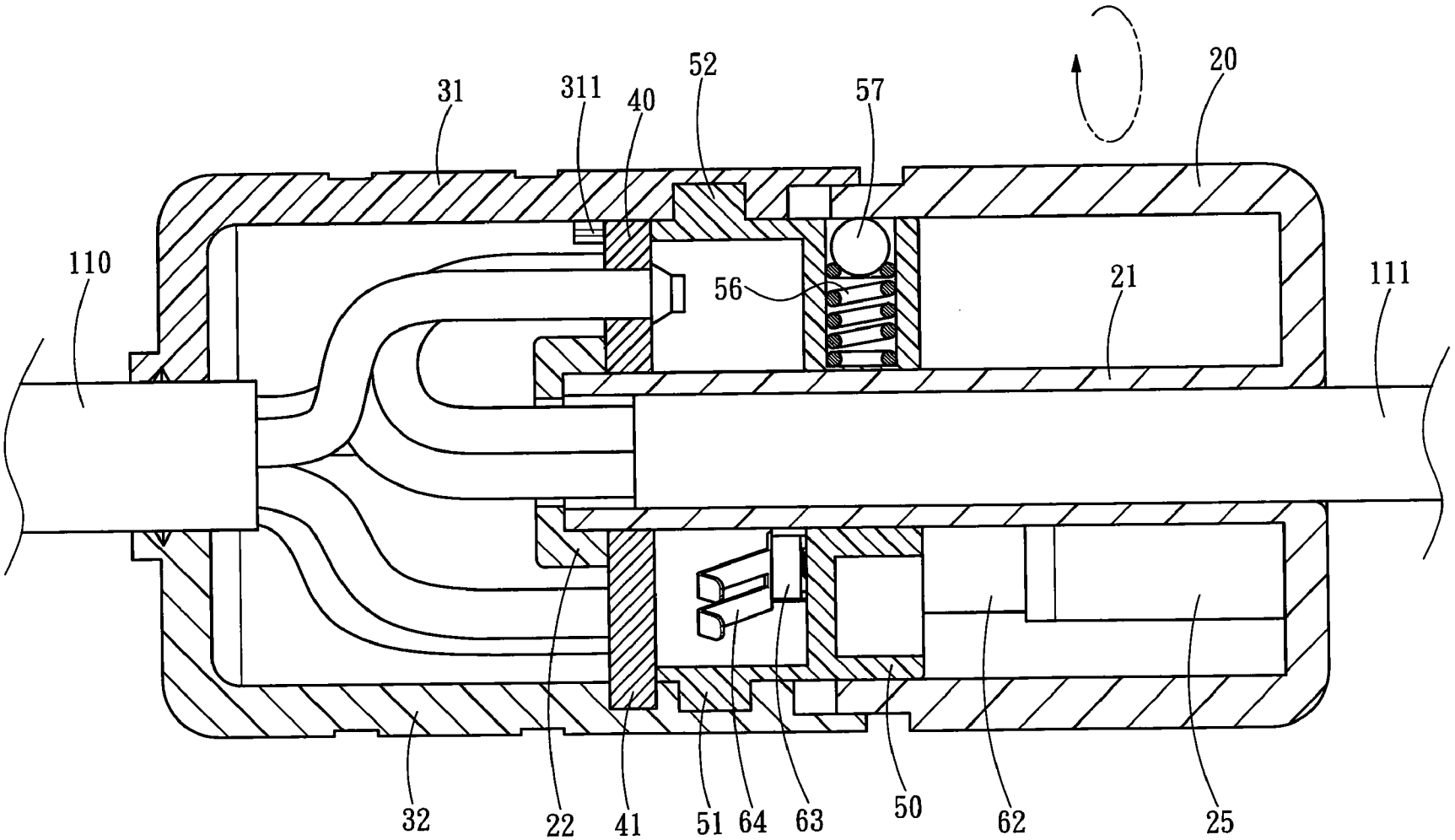
Figure 6C:
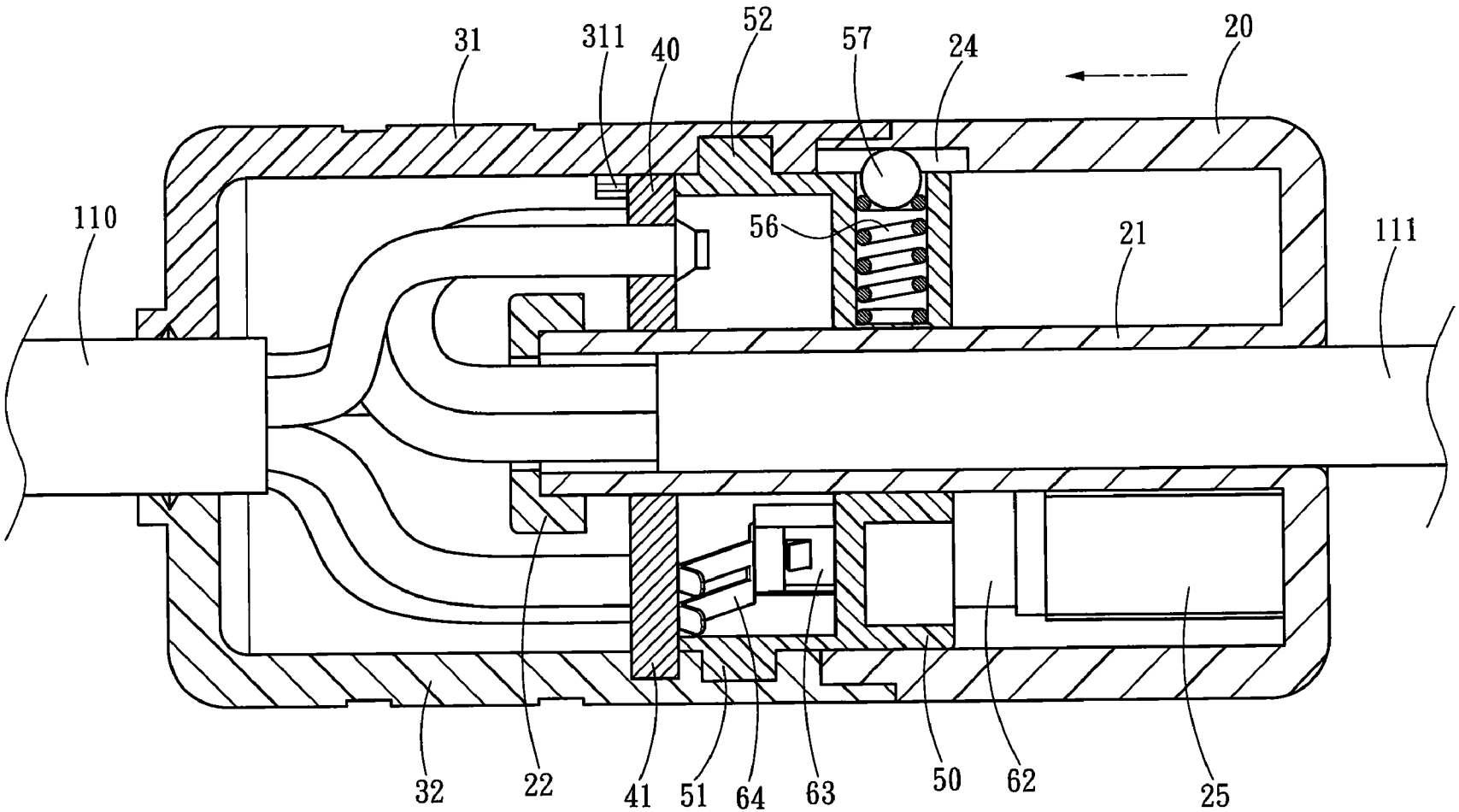
Figure 7A:
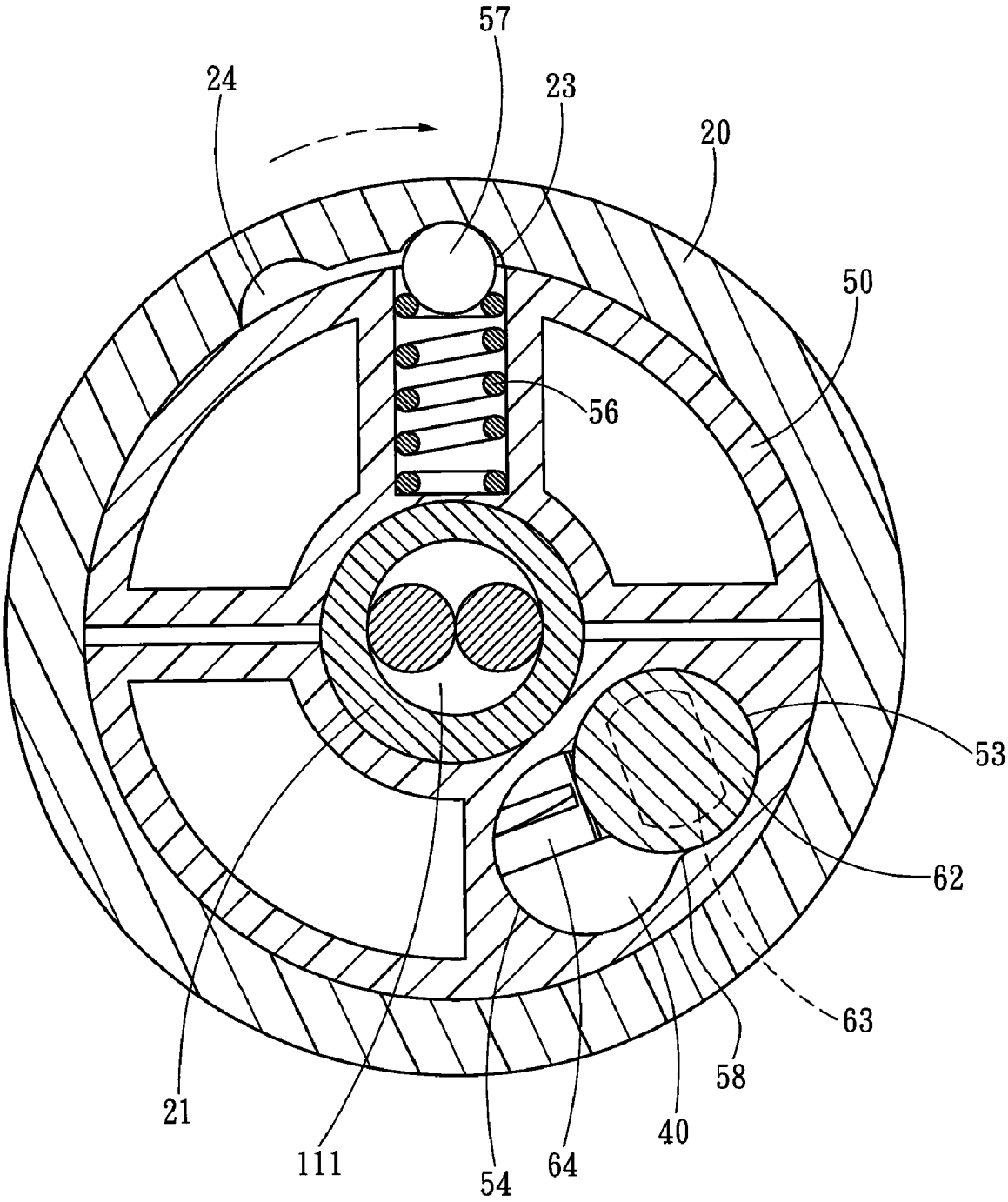
FIGS. 7A-7C are schematic views of the present invention in use condition-2.
Figure 7B:
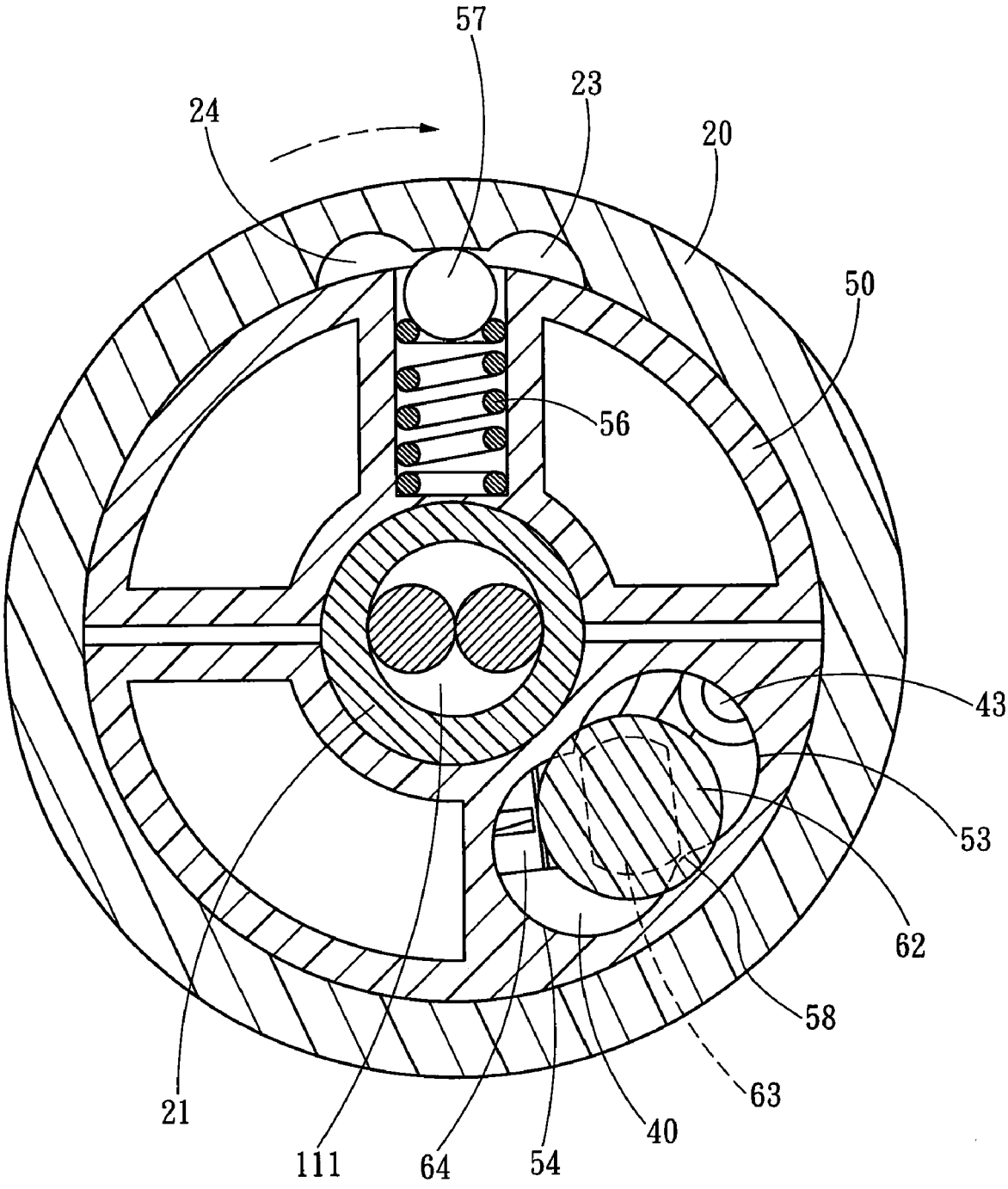
Figure 7C:
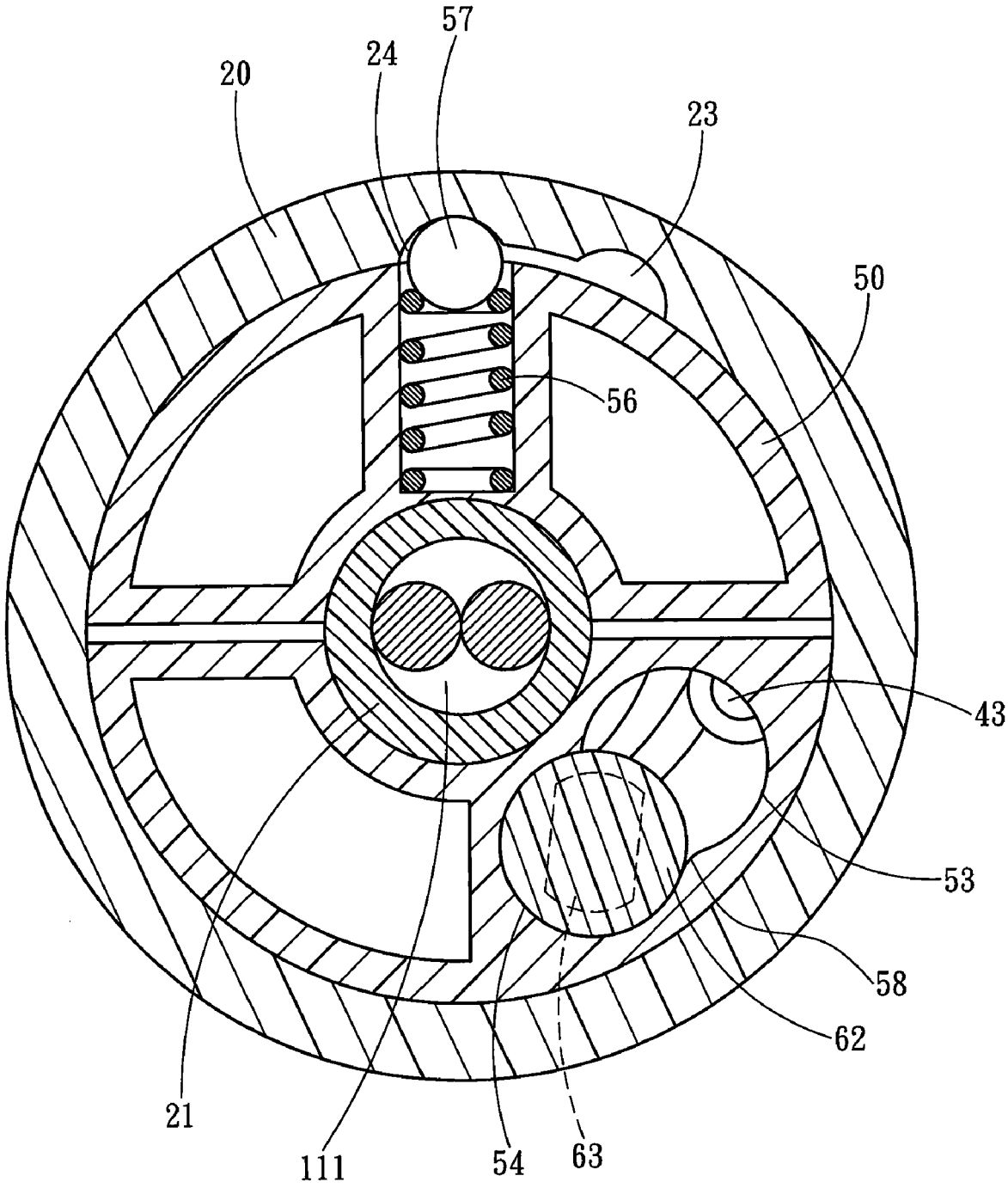
Figure 8A:
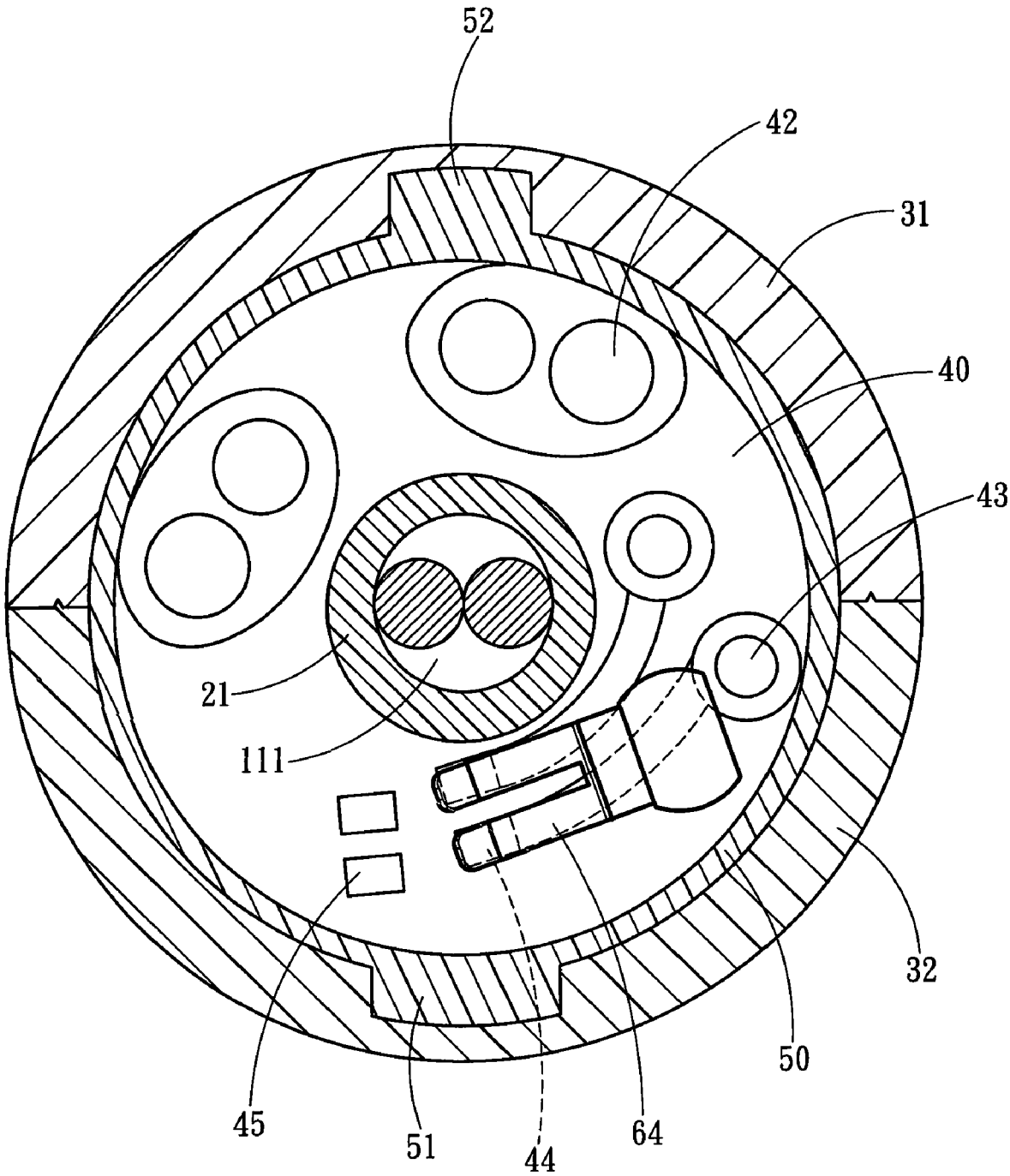
FIGS. 8A-8C are schematic views of the present invention in use condition-3.
Figure 8B:
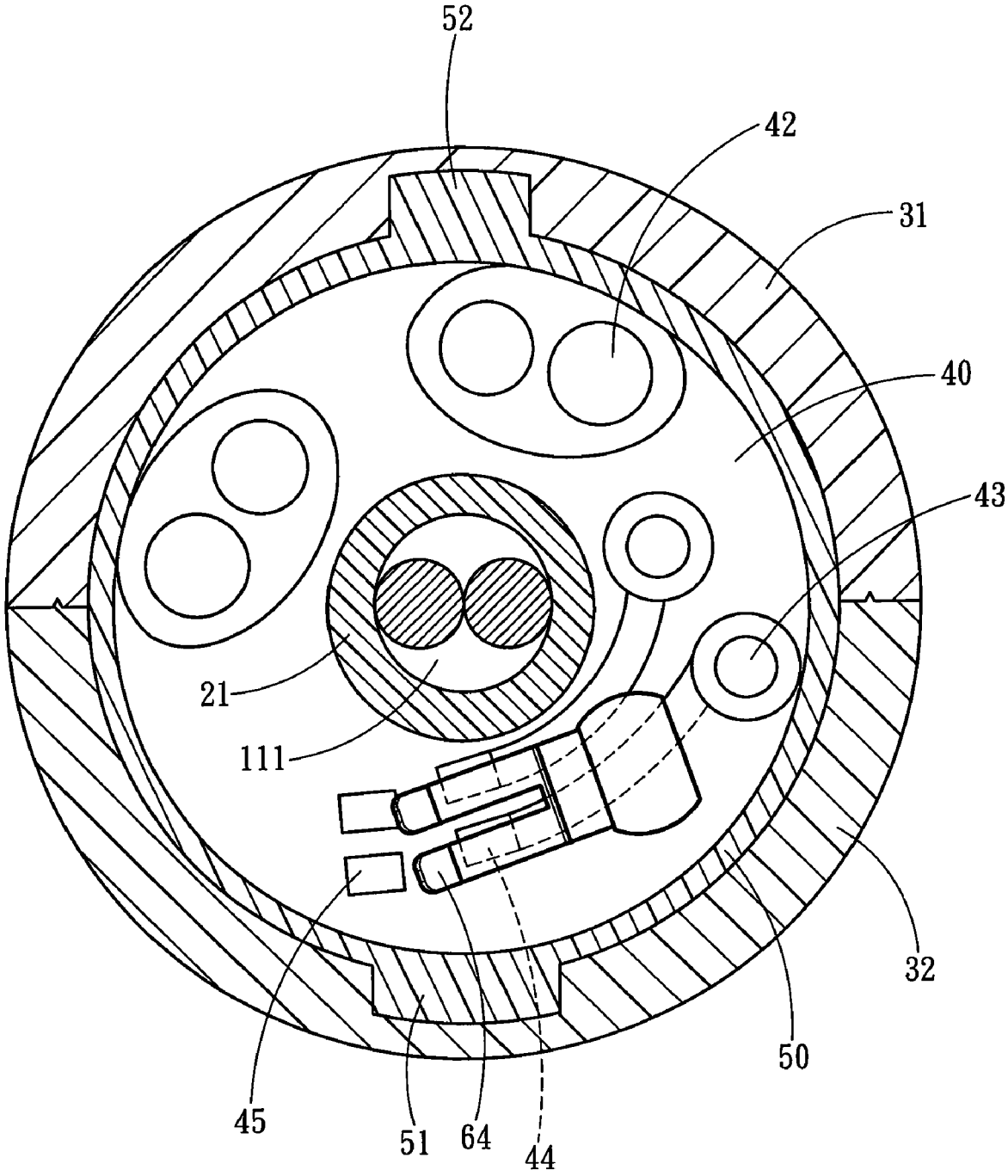
Figure 8C:
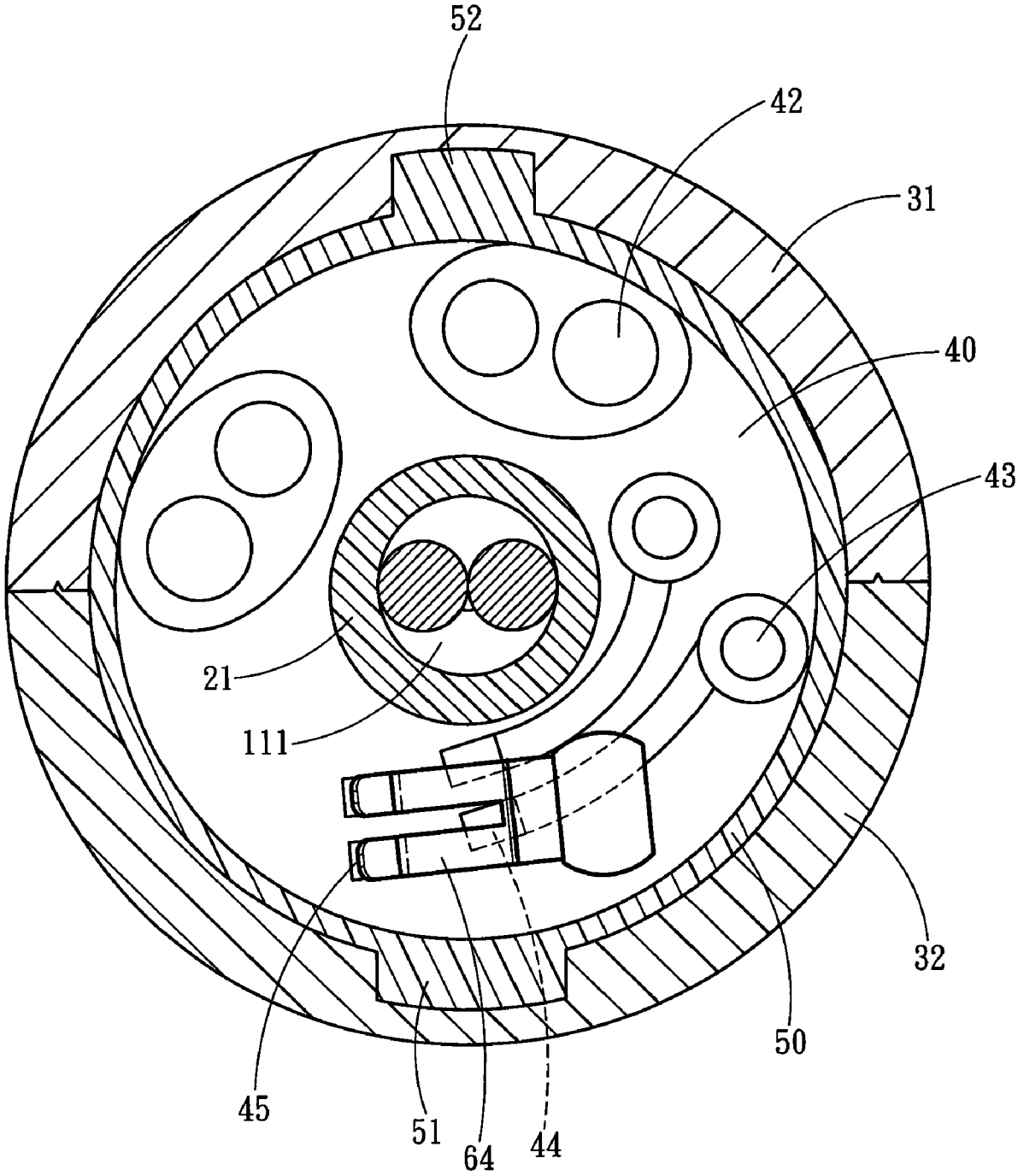

Refer to FIGS. 5 through 8C for the present invention in various use conditions. Initially, the anchor portion 62 of the switch stem 60 is confined by the restricting zone 58 in the first anchor hole 53 of the retaining member 50, and the retaining ball 57 is pressed by the elastic force of the spring 56 in the sliding track 23 of the second body 20, and the switch element 64 connects the first contact 44 of the shifting element 40 so that the output power is at the first potential (referring to FIGS. 5, 7A and 8A). When there is a desired to switch the output power to the second potential, first, pull the second body 20 with a force to move the switch element 64 away from the first contact 44; the detent member 22 of the turning axle 21 of the second body 20 pushes the shifting element 40, and the anchor portion 62 of the switch stem 60 is moved away from the first anchor hole 53 to release the anchor relationship therewith (referring to FIG. 6A); meanwhile, apply a turning force to rotate the second body 20 against the shifting element 40 and the retaining member 50 to remove the retaining ball 57 away from the sliding track 23 and compress the spring 56; the holding portion 63 drives the switch element 64 from the first anchor hole 53 through the restriction zone 58 towards the second anchor hole 54 (referring to FIGS. 6B, 7B and 8B) until the holding portion 63 is moved in the second anchor hole 54; the spring 56 pushes the retaining ball 57 to press against another sliding track 24 to ensure that the holding portion 63 is fully positioned in the second anchor hole 54; then push the second body 20 again towards the first body 30, and make the anchor portion 62 of the switch stem 60 to fall in the second anchor hole 54 of the retaining member 50 to form another anchoring relationship therewith. In such a condition, the switch element 64 connects to the second contact 45 of the shifting element 40 so that the output power is at the second potential (referring to FIGS. 6C, 7C and 8C). The first contact 44 and the second contact 45 may be formed at different impedances to generate different potentials, or when the switch element 64 connects the second contact 45 a feedback path may be formed leading to the power adapter 1 to deliver the output power at the second potential.

As a conclusion, the present invention, through the turning displacement of the second body 20 against the shifting element 40 of the first body 30, allows the switch element 64 to escape the first contact 44 and connect the second contact 45 to switch the potential. Moreover, through the first anchor hole 53 and second anchor hole 54 of the retaining member 50 the switch element 64 can be anchored securely while the second body 20 is turned to allow the power adapter 1 to deliver output power as desired. Furthermore, by means of installing the potential switching apparatus 2 on the power output cord 11, wiring of the internal circuit board in the power adapter 1 is simplified and the power adapter 1 can be shrunk to reduce production cost. Compared with the conventional techniques, the present invention provides significant improvements such as smaller size and greater portability to make carrying and use easier.

While the preferred embodiment of the present invention has been set forth for the purpose of disclosure, modifications of the disclosed embodiment of the present invention as well as other embodiments thereof may occur to those skilled in the art. Accordingly, the appended claims are intended to cover all embodiments which do not depart from the spirit and scope of the present invention.

What is claimed is:

1. A potential switching apparatus for a power adapter which transforms input power to output power delivered through a power output cord at a potential switchable by the potential switching apparatus, comprising:

a first body which is located on the power output cord and has a first contact and a second contact; and a second body which is located on the power output cord and has a switch element corresponding to the first contact and the second contact, the switch element being connectable to the first contact to deliver the output power at a first potential and connectable to the second contact to deliver the output power at a second potential;

wherein the potential switching apparatus is outside of a body of the power adapter.

2. The potential switching apparatus of claim 1, wherein the first body has a shifting element connecting to the power output cord, the first contact and the second contact being located on the shifting element.

3. The potential switching apparatus of claim 2, wherein the second body has an turning axle running through the shifting element such that the second body is turnable against the shifting element to form a turning displacement, the switch element being connectable to the first contact or the second contact in the turning displacement to allow the output power to be delivered at the first potential or the second potential.

4. The potential switching apparatus of claim 3, wherein the turning axle runs through a retaining member located on the first body to form a displacement against the retaining member.

5. The potential switching apparatus of claim 4, wherein the turning axle has a detent member to harness the shifting element in the displacement.

6. The potential switching apparatus of claim 4, wherein the second body has a switch stem running through the retaining member, the switch stem having a holding portion located on the switch element and an anchor portion, the retaining member having a first anchor hole and a second anchor hole to form an anchoring relationship with the anchor portion in the turning displacement of the second body.

7. The potential switching apparatus of claim 6, wherein the first anchor hole and the second anchor hole communicates with each other and are interposed by a restriction zone.

8. The potential switching apparatus of claim 7, wherein the anchor portion is formed at a diameter greater than that of the restriction zone which is greater than the holding portion.

9. The potential switching apparatus of claim 6, wherein the second body and the switch stem have respectively a first coupling portion and a second coupling portion that are coupled with each other.

10. The potential switching apparatus of claim 4, wherein the retaining member has a retaining cavity to hold a spring and a retaining ball braced by the spring, the second body having two sliding tracks latched by the retaining ball in the turning displacement.

11. The potential switching apparatus of claim 4, wherein the retaining member and the first body have respectively a fastening stub and a holding trough that are engaged with each other.

12. The potential switching apparatus of claim 2, wherein the power output cord includes a first cable connecting to the power adapter and running through the first body and connecting to the shifting element, and a second cable running through the second body and connecting to the shifting element.

13. The potential switching apparatus of claim 12, wherein the shifting element is an adapter circuit board which has power ports connecting to the first cable and the second cable.

14. The potential switching apparatus of claim 2, wherein the shifting element and the first body have respectively a coupling member and a coupling trough corresponding to and engaged with each other for anchoring.

15. The potential switching apparatus of claim 2, wherein the first body has a braking portion to harness the shifting element.

16. The potential switching apparatus of claim 1, wherein the first body has an upper case and a lower case corresponding to and coupled with each other.

* * * * *